US005457855A

United States Patent [19]

Kenney et al.

[11] Patent Number: 5,457,855

[45] Date of Patent: Oct. 17, 1995

[54] WOVEN SELF-ENGAGING FASTENER

[75] Inventors: Randall B. Kenney, Concord; Der-Shi Wang; Normand A. Cote, both of Bedford, all of N.H.

[73] Assignee: Velcro Industries, B.V., Netherlands

[21] Appl. No.: 204,991

[22] Filed: Feb. 28, 1994

[51] Int. Cl.[6] ..... A44B 18/00

[52] U.S. Cl. ..... 24/445; 24/442; 24/450

[58] Field of Search ..... 24/445, 446, 447, 24/448, 449, 450, 451, 452, 442, 306; 139/391

[56] References Cited

U.S. PATENT DOCUMENTS

| | | | |
|---|---|---|---|
| 2,238,098 | 4/1941 | Bradshaw | 139/391 |
| 2,434,709 | 1/1948 | Matthews | 139/391 |
| 2,503,583 | 4/1950 | Jackson | 139/391 |
| 3,136,026 | 6/1964 | De Mestral | 24/445 |
| 3,138,841 | 6/1964 | Naimer | 24/204 |
| 3,266,113 | 8/1966 | Flanagan | 24/204 |
| 3,320,649 | 5/1967 | Naimer | 24/445 |
| 3,408,705 | 11/1968 | Kayser et al. | 24/204 |
| 3,594,873 | 7/1971 | Hockmeyer, Jr. | 24/445 |
| 3,708,382 | 1/1973 | Erb | 24/451 |
| 3,900,652 | 8/1975 | Uraya et al. | 24/450 |
| 4,024,003 | 5/1977 | Buhler | 156/148 |
| 4,216,257 | 8/1980 | Schams et al. | 428/93 |
| 4,290,174 | 9/1981 | Kalleberg | 24/204 |
| 4,290,832 | 9/1981 | Kalleberg | 156/72 |
| 4,322,875 | 4/1982 | Brown et al. | 24/204 |
| 4,875,259 | 10/1989 | Appeldorn | 24/576 |
| 5,040,275 | 8/1991 | Eckhardt et al. | 24/447 |
| 5,077,870 | 1/1992 | Melbye et al. | 24/452 |
| 5,242,646 | 9/1993 | Torigoe et al. | 264/219 |

FOREIGN PATENT DOCUMENTS

| | | | |
|---|---|---|---|
| 5-199911 | 8/1993 | Japan . | |
| 0972648 | 10/1964 | United Kingdom | 24/446 |

*Primary Examiner*—Victor N. Sakran
*Attorney, Agent, or Firm*—Fish & Richardson

[57] ABSTRACT

A woven, self-engaging fastener with upright, mushroom-shaped, monofilament engaging elements that are in a thermally relaxed, stress-reduced condition. The engaging elements are arranged in a twill-like pattern such that weft-wise adjacent engaging elements are aligned diagonally to the weaving direction, and with sufficient density to enable the fastener to function as a self-engaging fastener.

The fastener is produced by weaving a three-dimensional, double plush weave having two layers of interwoven warp and weft threads, and monofilament fibers interwoven with and passing back and forth between the two layers. The monofilament fibers are relaxed by heating, then severed between the two layers.

22 Claims, 4 Drawing Sheets

WOVEN SELF-ENGAGING FASTENER

BACKGROUND OF THE INVENTION

The invention relates to self-engaging touch fasteners.

Self-engaging touch fasteners are known within the art. They typically have a base member with a multiplicity of engaging elements extending from the base member. The engaging elements are often mushroom-shaped and are usually integrally molded with or "staked" into the base member. Self-engaged fastening is effected by pressing the engaging elements of one fastener member into the similarly-shaped engaging elements of another fastener member such that the engaging elements interlock with each other.

Mushroom fasteners can also be used to engage pile-like loop elements. A well known method for making loop-engaging mushroom fasteners, as shown in U.S. Pat. No. 3,138,841 to Naimer, entails weaving two fabric base layers together with monofilament plastic, then slicing through the monofilament with a hot knife to separate the layers. The hot knife melts the plastic, causing the separated ends of the monofilaments to flow back on themselves to form the mushroom heads. This method produces two separate fastener strips, each having monofilament mushroom elements extending from a woven fabric base member.

SUMMARY OF THE INVENTION

In one aspect, in general, the invention features a woven, self-engaging touch fastener member having a woven base layer with warp threads and weft threads, and a multiplicity of discrete monofilament engaging elements interwoven with the warp and weft threads and extending substantially upright from the base layer. The engaging elements are arranged in rows aligned with the warp threads, and engaging elements in adjacent rows are offset relative to each other by at least one weft thread such that weft-wise adjacent engaging elements are aligned diagonally across the grid defined by the warp and weft threads. Additionally, the engaging elements are arranged in sufficient density to enable the touch fastener to function as a self-engaging touch fastener.

In another aspect, in general, the invention features a woven, self-engaging touch fastener member having a woven base layer with warp threads and weft threads, and a multiplicity of discrete monofilament engaging elements interwoven with the warp and weft threads and extending from the base layer. The engaging elements are in a post-weaving, thermally relaxed condition of reduced stress such that they extend substantially upright relative to the base layer. The engaging elements are arranged in a pattern, and with sufficient density, to enable the fastener to function as a self-engaging touch fastener.

In another aspect, in general, a touch fastener member is provided having, in combination, all features described thus far.

Embodiments of the various aspects of the invention may include the following features. The engaging elements may have a mushroom profile. They may be upright as a result of heating, and they may be pigmented to facilitate heating.

The engaging elements may be arranged in a weave pattern having a twill-like appearance. The twill-like appearance may form a substantially checkerboard pattern. There may be in excess of five hundred engaging elements per square inch, and preferably about five hundred thirty engaging elements per square inch.

In yet another aspect, the invention features a method for producing a woven, self-engaging touch fastener. A three-dimensional, double plush weave is woven with two layers of interwoven warp and weft threads, and monofilament fibers interwoven with and passing back and forth between the two layers. Adjacent monofilament fibers are woven with portions crossing between the layers of warp and weft threads in a staggered pattern such that the crossing portions are arranged in rows aligned with the warp threads and crossing portions in adjacent rows are offset relative to each other by at least one weft thread. Stress in the monofilament fibers is thermally relaxed, and the two layers are separated by severing the monofilament fibers between the two layers of warp and weft threads. The severed monofilament fibers, which remain substantially upright to the layers after the layers are separated, form the engaging elements. The staggered pattern and the density of the crossing portions enables the touch fastener to function as a self-engaging touch fastener.

The engaging elements may have a mushroom profile. The staggered configuration may comprise a twill-like weave pattern, which may be a substantially checkerboard pattern. The monofilament weave density is such as to produce a fastener with in excess of five hundred engaging elements per square inch, and preferably about five hundred thirty engaging elements per square inch.

Thus, a self-engaging fastener is provided that is produced as a woven fastener, and which has excellent tensile strength and shear strength.

DESCRIPTION OF THE PREFERRED EMBODIMENTS

Figure 1:
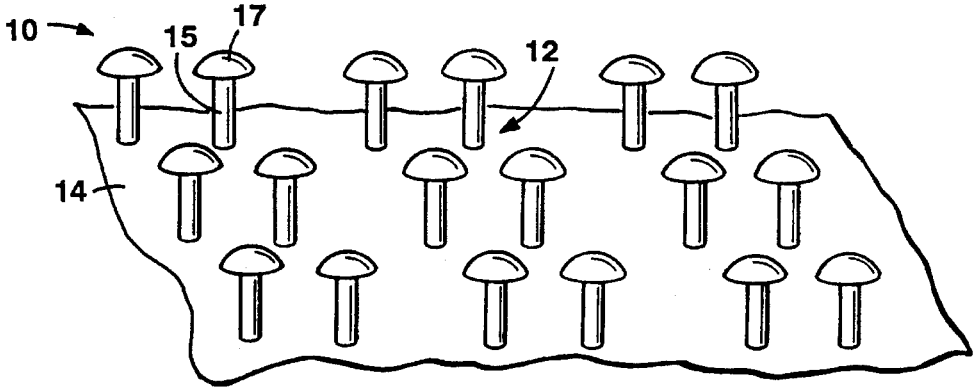
FIG. 1 is a perspective view of a woven, self-engaging fastener.

A woven self-engaging mushroom fastener 10 (FIG. 1) has in excess of five hundred mushroom-shaped engaging elements 12 per square inch of woven base member 14. Each engaging element has a stem 15 and a mushroom head 17. The engaging elements extend substantially upright to the base member and they are, for the most part discrete, i.e., very few—if any—are fused together.

Figure 2A:
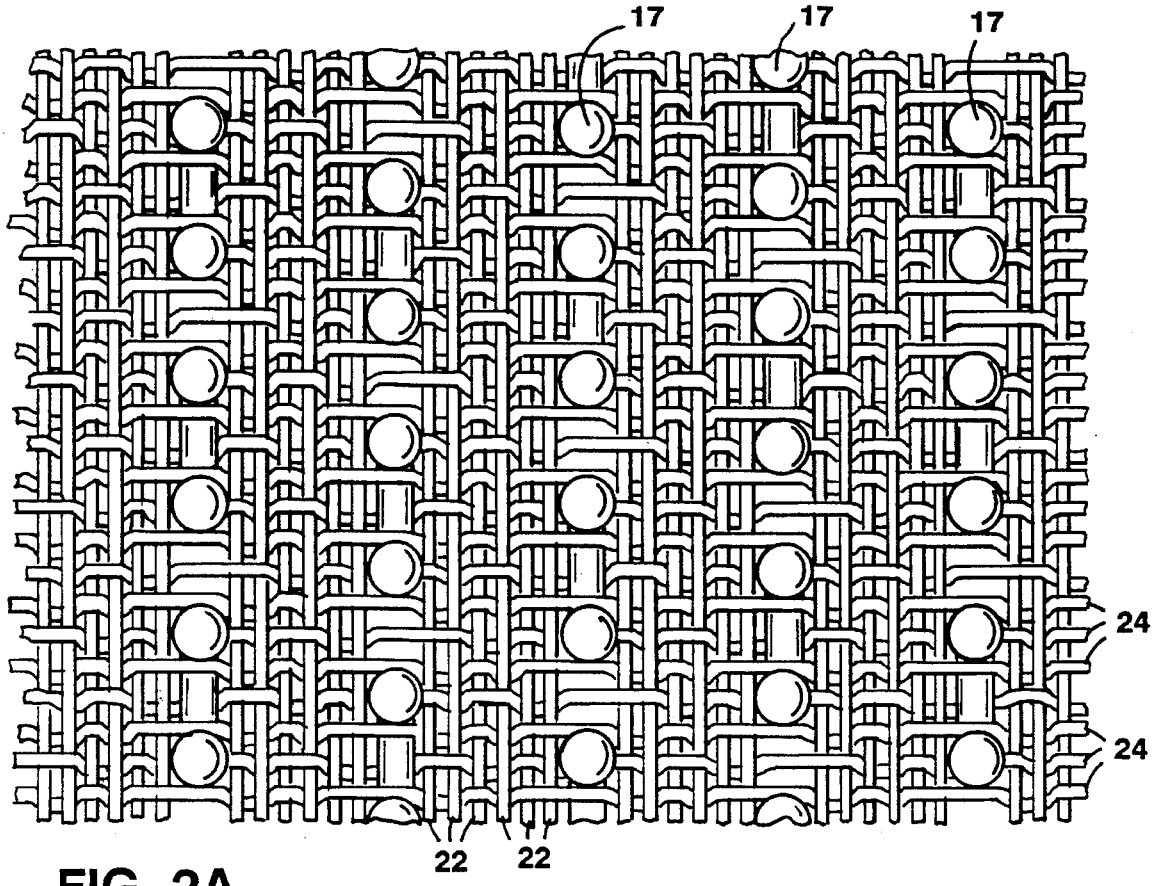
FIG. 2A is a close-up plan view of a woven, self engaging faster showing details of the weave pattern.
Figure 2:
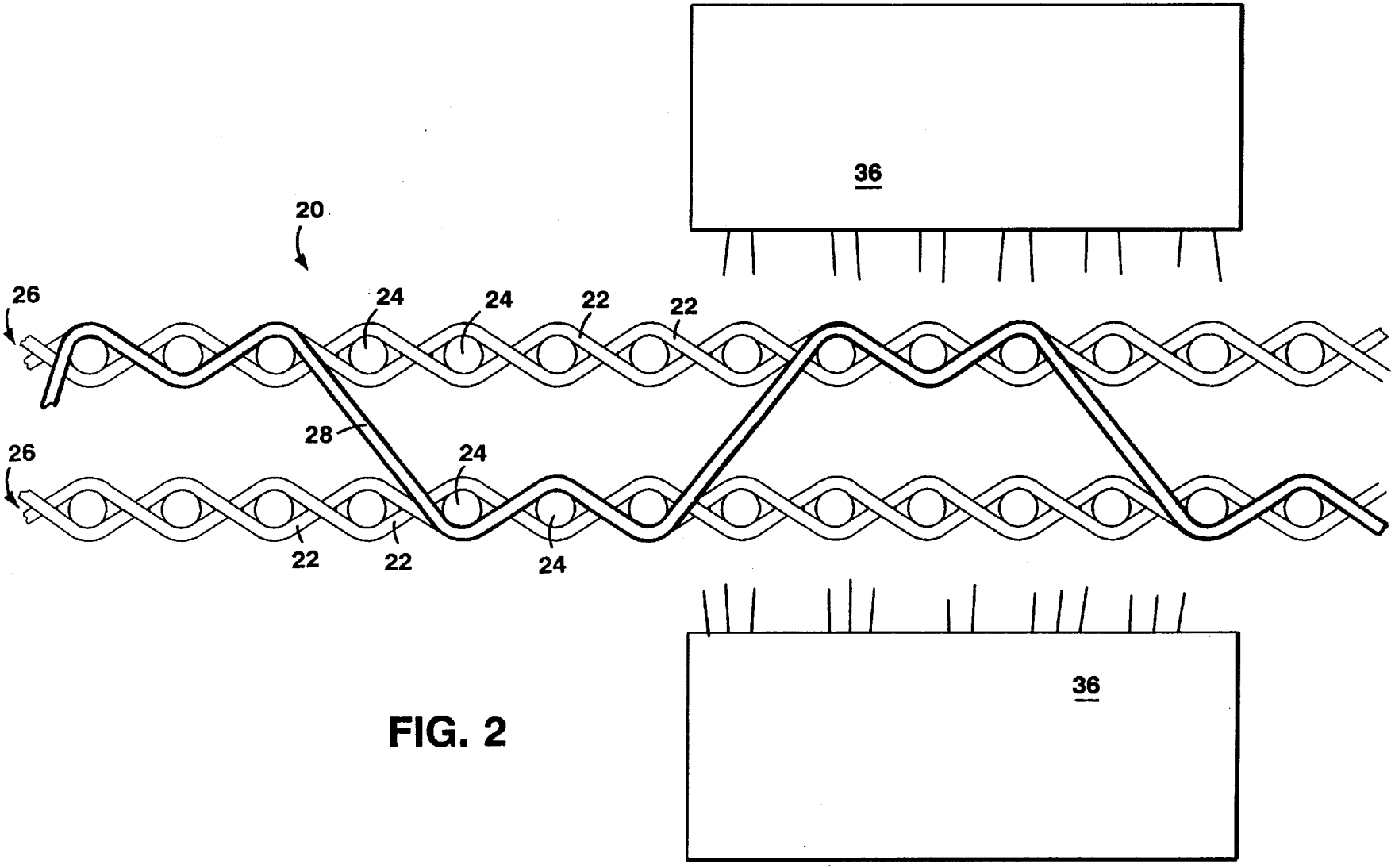
FIG. 2 is a side view of a double plush weave used to make a woven self-engaging fastener.
Figure 3:
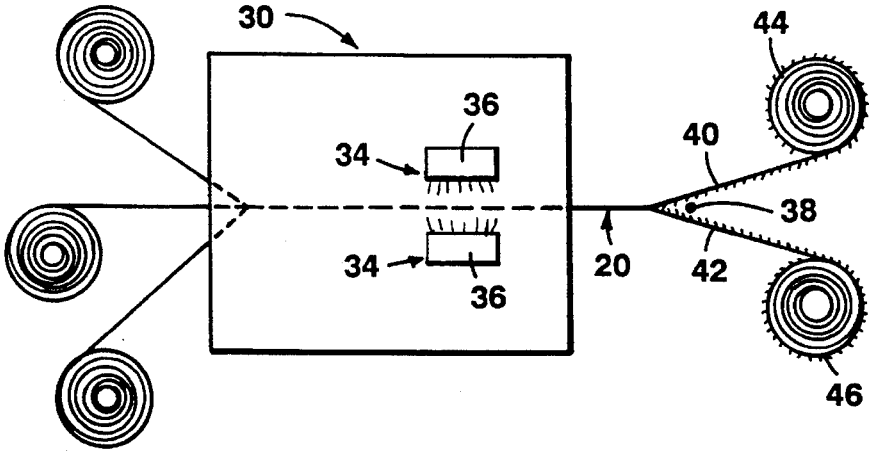
FIG. 3 is a schematic side view of a method of making a woven self-engaging fastener.

To produce the fastener, a three-dimensional, double plush weave 20, shown schematically in FIG. 2, is manufactured using, e.g., the NF model of a Müller Patax loom 30 (FIG. 3). The warp threads 22 and weft threads 24 which form the two base layers 26 are typically 100 denier, 0.13 mm diameter, type-66 nylon. The weft threads are preferably double stranded, making them 200 denier and approximately 0.26 mm combined diameter, but they are shown as single stranded for clarity. The monofilament cross fibers 28, which connect the two base layers and which will form the mushroom elements, are preferably 0.40 mm diameter polypropylene. There should be on the order of one hundred sixty to two hundred warp threads per inch in the cross-weave direction, and sixty to eighty weft threads per inch in the weave direction. The weaving pattern, shown more clearly in FIG. 2A, is preferably set such that the finished fastener has approximately five hundred thirty engaging elements per square inch.

The loom is set to weave the monofilament cross fibers in parallel with the warp fibers, back and forth between the two base layers in a serpentine, W-shaped path as shown. In this embodiment, adjacent cross fibers are spaced from each other by six warp threads. The loom is set to weave the cross fibers to produce a staggered, twill-like pattern of crossing portions, i.e., with crossing portions of successive cross fibers offset in the warp direction by one weft thread. Thus, the portions of the fibers which cross from one base layer to the other, and which will form the upstanding engaging elements 12, are arranged in rows aligned with the warp threads, while weft-wise adjacent crossing portions are aligned diagonally to the warp and weft directions. This twill-like configuration is shown in FIG. 2A.

While the weave 20 is still under the tension provided by the loom, both base layers are heated—one from above and one from below—by radiant heating 34 using ceramic heating cartridges 36. Various process parameters are controlled such that the temperature of the heated surfaces of the base layers rises to be on the order of 200° to 250° F. For example, the temperature of the cartridges, preferably 800° to 1000° F., and the distance of the cartridges from the base layers, preferably three quarters of an inch plus or minus a quarter, can both be varied somewhat. Additionally, the feed rate of the weave 20 can be controlled such that the appropriate surface temperature is obtained.

It is also possible to enhance the heating by varying the color of the monofilament cross fibers. For example, pigmenting the monofilament cross fibers black enhances their ability to absorb radiant heat energy by functioning as black bodies. Furthermore, the warp and weft threads can be pigmented to control their energy absorption, e.g., by pigmenting them white to absorb less heat than the cross fibers.

The elevated temperature should be maintained for approximately twenty seconds, i.e., long enough for the cross fibers to relax and for internal stress, where the cross fibers wrap around the weft threads, to be released. The precise temperature, and the amount of time the base layers should be maintained at that temperature, will, however, vary depending on the particular materials and weaving pattern selected.

About ten seconds after the base layers are heated, they are separated by severing the monofilament cross fibers with a heated nichrome wire 38 or knife. The cross fibers must not, however, be cut prematurely. Rather, they must be allowed to cool sufficiently such that they heat-set in the woven configuration. The time and distance the weave travels before being split will, of course, vary depending on the feed rate of the weave and ambient conditions.

As is known in the art, the heated wire causes the severed ends of the monofilaments to melt back on themselves, thereby forming the mushroom heads of the engaging elements. The heads cool, under ambient conditions, within a few inches of the wire, and the two separate strips 40, 42 of mushroom fasteners are taken up on windup spools 44, 46.

It is heating the base layers, combined with the weave pattern and density of the monofilament fibers, that allows the woven mushroom fastener to be used satisfactorily as a self-engaging fastener, as opposed to just as a mushroom-to-loop fastener. For acceptable fastening performance, the engaging elements of a self-engaging fastener need to be relatively sturdy. At 0.40 mm diameter, which is approximately three times the diameter of the warp threads and 1.5 times the diameter of the weft threads, the monofilament fibers meet this requirement. (The precise warp, weft, and monofilament diameters, and their relative proportions, are not, however, critical; variation for the particular end use of the product is allowable.)

Figure 4:
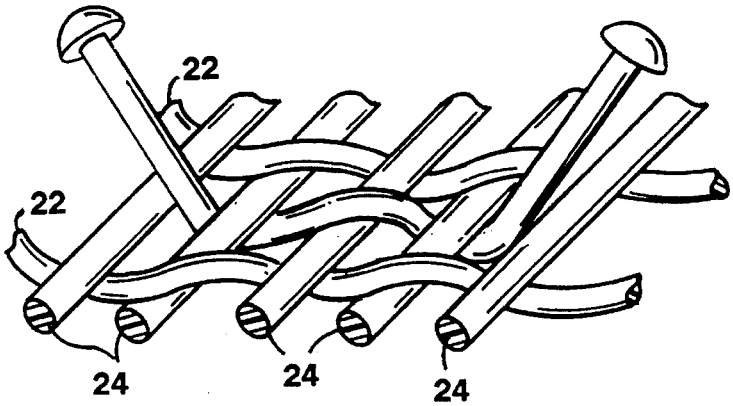
FIG. 4 is a close-up, perspective view of engaging elements of a Woven fastener made without heating.

The relatively large diameter of the monofilament fibers, however, makes them relatively stiff. As a result, the cross fibers do not wrap tightly around the weft threads and tend to spread apart in a wide W-configuration. Accordingly, the engaging elements of a fastener produced without heating are canted relative to the base member, as shown in FIG. 4, which inhibits interlocking of the engaging elements.

Figure 5:
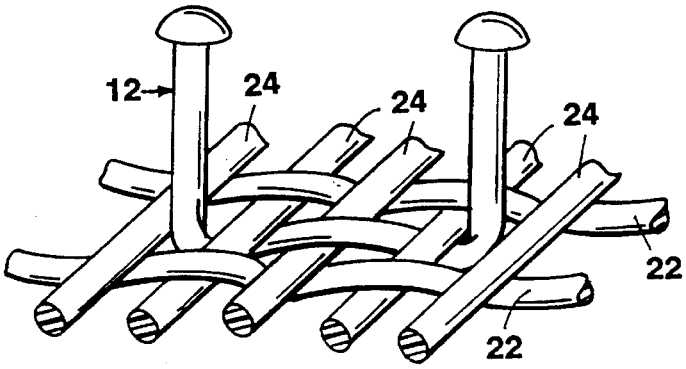
FIG. 5 is a close-up, perspective view of engaging elements of a woven fastener made with heating.

Heating the base layers, however, relaxes the monofilament fibers, thereby releasing stress created by bending the monofilament fibers around the weft threads. Furthermore, heating causes the weave of the base layers to tighten slightly. This secondary effect draws together the portions of the monofilament fibers which pass between the base layers such that they extend substantially upright to the base layers. Because the fibers are relaxed by releasing internal stress, then cooled to heat-set them, the engaging elements 12 remain substantially upright to the base member 14 when the monofilament cross fibers are cut, as shown in FIG. 5. Because the engaging elements remain substantially upright to the base member, more comprehensive interlocking of the engaging elements is obtained.

Figure 7:
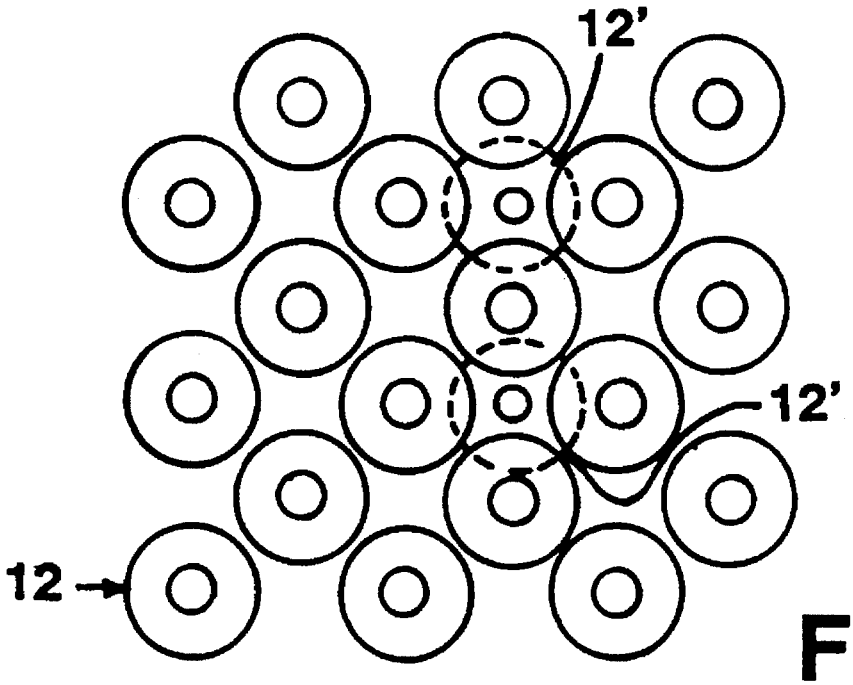
FIGS. 6 and 7 are side and top views, respectively, of a woven, self-engaging fastener made with heating.
Figure 6:
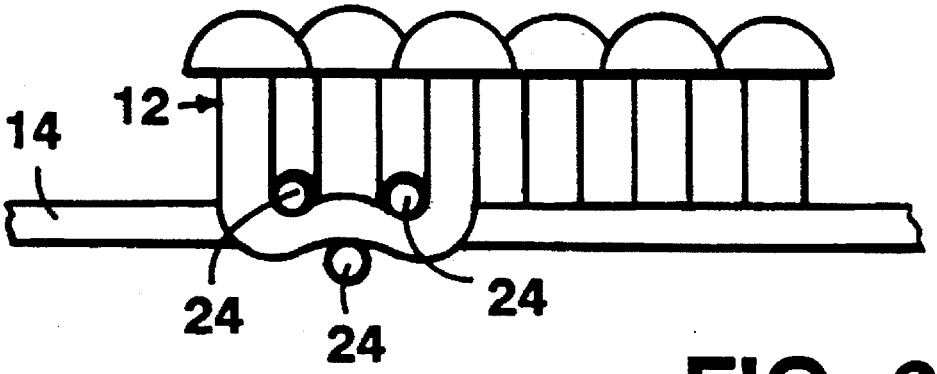

It is also important for density purposes that the engaging elements be upright. As shown in FIGS. 6 and 7, the engaging elements 12 are "packed" relatively densely, which is necessary for good tensile strength and angular shear strength. Because the engaging elements 12 are relatively densely packed at five hundred or more per square inch, the engaging elements 12' of a mating fastener strip fit between the engaging elements 12 with little excess space. If the engaging elements 12' of the mating strip are pulled away from the engaging elements 12, the mating elements 12' engage the heads of four separate elements 12. Similarly, when the fastener is subjected to shear forces, the mating engaging elements 12' encounter engaging elements 12 in virtually any direction. Thus, the high density of the engaging elements gives the fastener excellent tensile strength and shear strength.

Thus, densely packing the monofilament fibers in a twill pattern, then heating the base layers to relax the monofilament fibers and leave them upright to the base layers after slicing the base layers apart, allows one to produce a woven self-engaging mushroom fastener with excellent tensile and shear restraining capabilities.

Other embodiments are within the scope of the following claims. For example, other types of heating might be used, e.g., radiant heating by coils or filaments, convective heating by hot air, or, in the case of induction sensitive monofilaments, inductive heating.

What is claimed is:

1. A woven, self-engaging touch fastener member comprising a woven base layer having warp threads and weft threads, and a multiplicity of discrete engaging elements of monofilament interwoven with said warp threads and said weft threads and extending substantially upright from said base layer, said engaging elements being configured for self-engaging fastening by engagement with other similarly configured engaging elements, said engaging elements being arranged in rows aligned with said warp threads, engaging elements in adjacent rows being offset relative to each other by at least one weft thread such that weft-wise adjacent engaging elements are aligned diagonally across the grid defined by said warp threads and said weft threads, said engaging elements being arranged in sufficient density to enable said touch fastener to function as a self-engaging touch fastener.

2. The fastener member of claim 1 wherein said engaging elements have a mushroom profile.

3. The fastener member of claim 1 wherein said engaging elements extend substantially upright to said base layer as a result of heating.

4. The fastener member of claim 3 wherein said engaging elements are pigmented to facilitate said heating.

5. The fastener member of claim 1 wherein said engaging elements are arranged in a pattern having a twill-like appearance.

6. The fastener member of claim 5 wherein said twill-like appearance forms a substantially checkerboard pattern.

7. The fastener member of claim 1 wherein said density is in excess of about five hundred engaging elements per square inch.

8. The fastener member of claim 7 wherein said density is about five hundred thirty engaging elements per square inch.

9. A woven, self-engaging touch fastener member comprising a woven base layer having warp threads and weft threads, and a multiplicity of discrete engaging elements of monofilament interwoven with said warp threads and said weft threads and extending from said base layer, said engaging elements being configured for self-engaging fastening by engagement with other similarly configured engaging elements, said engaging elements being in a post-weaving, thermally relaxed condition of reduced stress with said engaging elements extending substantially upright relative to said base layer, said engaging elements being arranged in a pattern and with sufficient density to enable said touch fastener to function as a self-engaging touch fastener.

10. The fastener member of claim 9 wherein said engaging elements have a mushroom profile.

11. The fastener member of claim 9 wherein said engaging elements are pigmented to facilitate thermal relaxation.

12. The fastener member of claim 11 wherein said density is about five hundred thirty engaging elements per square inch.

13. The fastener member of claim 9 wherein said density is in excess of about five hundred engaging elements per square inch.

14. A woven, self-engaging touch fastener member comprising a woven base layer having warp threads and weft threads, and a multiplicity of discrete engaging elements of monofilament interwoven with said warp threads and said weft threads and extending from said base layer, said engaging elements being configured for self-engaging fastening by engagement with other similarly configured engaging elements, said engaging elements being in a post-weaving, thermally relaxed condition of reduced stress with said engaging elements extending substantially upright relative to said base layer, said engaging elements being arranged in rows aligned with said warp threads, engaging elements in adjacent rows being offset relative to each other by at least one weft thread such that weft-wise adjacent engaging elements are aligned diagonally across the grid defined by said warp threads and said weft threads, said engaging elements being arranged in sufficient density to enable said touch fastener to function as a self-engaging touch fastener.

15. A method for producing a woven, self-engaging touch fastener member having a base layer of interwoven warp threads and weft threads, and a multiplicity of engaging elements of monofilament extending from said base layer, said method comprising weaving a three-dimensional, double plush weave having two layers of interwoven warp threads and weft threads and monofilament fibers interwoven with and passing back and forth between said two layers, thermally relaxing said monofilament fibers to reduce stress therein, separating said layers by severing said monofilament fibers between said layers, said severed monofilaments remaining substantially upright to said layers of warp threads and weft threads after said separating, and forming said monofilament fibers into said engaging elements, said engaging elements being configured for self-engaging fastening by engagement with other similarly configured engaging elements, wherein adjacent monofilament fibers are woven with portions crossing between said layers of warp and weft threads in a staggered pattern such that said crossing portions are arranged in rows aligned with said warp threads and crossing portions in adjacent rows are offset relative to each other by at least one weft thread, said staggered pattern and the density of said crossing portions enabling said touch fastener to function as a self-engaging touch fastener.

16. The method of claim 15 wherein said engaging elements have a mushroom profile.

17. The method of claim 15 wherein said monofilament fibers are pigmented to facilitate thermal relaxation.

18. The method of claim 15 wherein said staggered pattern comprises a weave pattern having a twill-like appearance.

19. The method of claim 18 wherein said twill-like appearance forms a substantially checkerboard pattern.

20. The method of claim 15 wherein said density is such that said fastener element produced by said method has in excess of about five hundred engaging elements per square inch.

21. The method of claim 20 wherein said density is such that said fastener element produced by said method has about five hundred thirty engaging elements per square inch.

22. A woven, self-engaging fastener produced by the method of claim 15.

* * * * *